US008286828B2

(12) United States Patent
Schäfer

(10) Patent No.: US 8,286,828 B2
(45) Date of Patent: Oct. 16, 2012

(54) TRANSPORT/STORAGE CONTAINER WITH SELF-LOCKING COVER

(75) Inventor: Gerhard Schäfer, Neunkirchen (DE)

(73) Assignee: Fritz Schaefer GmbH, Neunkirchen (DE)

( * ) Notice: Subject to any disclaimer, the term of this patent is extended or adjusted under 35 U.S.C. 154(b) by 1269 days.

(21) Appl. No.: 11/509,541

(22) Filed: Aug. 24, 2006

(65) Prior Publication Data

US 2007/0045331 A1 Mar. 1, 2007

(30) Foreign Application Priority Data

Aug. 24, 2005 (DE) ..... 20 2005 013 351 U

(51) Int. Cl.
*B65D 51/04* (2006.01)

(52) U.S. Cl. ..... 220/826; 220/827; 220/828; 220/324; 220/326

(58) Field of Classification Search ..... 220/826, 220/827, 828, 324, 326
See application file for complete search history.

(56) References Cited

U.S. PATENT DOCUMENTS 3,463,345 A * 8/1969 Bockenstette ..... 220/826
4,161,261 A * 7/1979 Frater ..... 220/826
4,364,489 A * 12/1982 Alexeeff ..... 220/826
4,432,467 A * 2/1984 Swingley, Jr. ..... 220/826
4,620,644 A * 11/1986 Miller ..... 220/826
4,765,480 A * 8/1988 Malmanger ..... 206/506
5,051,725 A * 9/1991 Caccitolo ..... 340/571
5,328,048 A * 7/1994 Stein ..... 220/826
5,353,948 A * 10/1994 Lanoue et al. ..... 220/826
5,673,791 A * 10/1997 Jamison ..... 206/508
6,000,576 A * 12/1999 Liu ..... 220/826
6,431,394 B2 * 8/2002 Frankenberg ..... 220/826
2002/0008114 A1 * 1/2002 Frankenberg ..... 220/826
2005/0218150 A1 * 10/2005 Cadiente ..... 220/826
2006/0186123 A1 * 8/2006 Baltz et al. ..... 220/324

FOREIGN PATENT DOCUMENTS

DE 92 12 813 2/1993

* cited by examiner

*Primary Examiner* — Anthony Stashick
*Assistant Examiner* — Christopher McKinley

(57) ABSTRACT

A storage/transport container has a plurality of walls defining an upwardly open vessel having an upper rim and a generally flat cover panel hinged on one of the walls and having an inner edge. The rim has opposite to one of the walls structure forming another inner edge. The cover panel is pivotal into a closed position with the inner edges juxtaposed, retaining formations projecting generally perpendicularly from the inner edge of the cover panel and oppositely from the other inner edge that fit together in the closed position. Hooks are formed on the edges and positioned so as to be opened directly at each other in the closed position. The hooks normally are spaced apart but, on deformation of the cover panel, hook together and preventing separation of the edges.

12 Claims, 4 Drawing Sheets

TRANSPORT/STORAGE CONTAINER WITH SELF-LOCKING COVER

FIELD OF THE INVENTION

The present invention relates to reusable storage/transport container or box. More particularly this invention concerns such a container that has a hinged cover.

BACKGROUND OF THE INVENTION

A standard stackable storage/transport container has four walls and a floor forming an upwardly open generally parallelepipedal vessel having a rectangular upper rim. A one-piece or two-piece cover is hinged on the rim and can be interlocked with the upper rim of the container by means of a connection in the form of interfitting retaining formations. With a two-piece or two-panel cover, the inner edges of the cover panels are locked together by the retaining formations. In this case the inner edges typically overlay at least partially.

Such containers, generally made of plastic and produced by an injection-molding procedure, with an attachable cover or a cover hinged at one side and interlockable with the upper rim of the container or with a two-piece cover are well known. In the case of a container known from DE 92 12 813 with a cover consisting of two panels, the free inner edges of which overlap along at least one section of a closure line, the overlapping inner edges can be interlocked by means of interfitting retaining formations. These formations include at least one longitudinal ridge and a pocket in the corresponding container rim or panel edge coordinated thereto.

A box or container known from U.S. Pat. No. 4,432,467 has a two-piece cover, with, in a first embodiment, a linear closure line as the two halves of the cover each have one overlapping cover tab and in a different embodiment a wave-like closure line with several overlapping cover tabs. There, the overlapping areas are in any case designed such that in the closed state bars provided at the inner side, transverse side and longitudinal side at the one cover half frame block-like projections at the upper side of the other cover half. These bar-like and block-like fittings are there to restrain a relative side movement when the halves of the cover close the box and when full containers are stacked one upon the other, their weight bears on the container below or the containers below. A further support in the closed state of this box is given by the fact that the corner areas of the halves of the cover overlap as well and interlock due to projections pointing downward in these facing recesses.

The known covers showed, however, that a deformation of the interlocking elements (groove-ridge connection or block interlocking with resistance areas) under heavy load cannot be excluded, the interlocking elements being forced into an inclined position and then sliding over each other and thus the eliminating form-fitting connection. Consequently, the cover, especially a two-piece cover, collapses completely along the closure line, which additionally implicates a risk of injury. As a result, it is important to consider that the containers when stacked one upon the other with their covers closed, have to bear a significant load acting on them, especially on the lower containers. The weight of the load is distributed over the central sections of the cover and the interlocking connection is detached, particularly in the case of two-piece covers.

OBJECTS OF THE INVENTION

It is therefore an object of the present invention to provide an improved transport/storage container with self-locking cover.

Another object is the provision of such an improved transport/storage container with self-locking cover that overcomes the above-given disadvantages, in particular that does not have the disadvantages described, i.e. that prevents a detaching of the interlocking connection and thus a collapse of the cover both with both a one-piece cover and a two-piece cover, which nonetheless should close in an unmodified soft way.

SUMMARY OF THE INVENTION

A storage/transport container has according to the invention a plurality of walls defining an upwardly open vessel having an upper rim and a generally flat cover panel hinged on one of the walls and having an inner edge. The rim has opposite to one of the walls structure forming another inner edge. The cover panel is pivotal into a closed position with the inner edges juxtaposed, retaining formations projecting generally perpendicularly from the inner edge of the cover panel and oppositely from the other inner edge that fit together in the closed position. Hooks are formed on the edges and positioned so as to be opened directly at each other in the closed position. The hooks normally are spaced apart but, on deformation of the cover panel, hook together and preventing separation of the edges.

In other words this object is attained according to the invention by additional interlocking means in the form of hooks or bolts which are inversely arranged and move against each other and are engaged when the container is loaded and the cover is deformed. Thus, by providing additional hooking or locking elements, preferably a plurality of such elements spread along the length of the cover, in contrast to the former development of interlocking, a relative movement when load is applied is explicitly made possible which leads to a more intense engagement, and the existing groove-ridge connection or other interlocking elements on the underside and on the surface of the halves of the cover or on the underside of the one-piece cover and on the container inner edge cannot lose contact. Thus, a gliding or a bending and, as far as a two-piece cover is concerned, a drifting apart of the groove-ridge elements connecting the overlapping halves of the cover is avoided and thereby a collapse of the cover or of the halves of the cover is excluded.

A preferred embodiment of the invention provides that the hooking and locking elements consist of basically L-shaped upper bolt stems with a lower bolt head projecting toward the inner side and lower, basically L-shaped bolt stems with a high lying bolt head projecting toward the outer side. When loaded, the bolt heads shift and overlap each other, their length delimiting the extent of shifting since the projection stems meet an end stop at the vertical section of the L-shaped bolt heads. The shift is longer the heavier the load. The free movability or shiftability into each other can be aided by a rounded outline of the bolt projections. The cover increasingly locks itself with its hooking and locking elements even under heavy loads, and particularly the halves of the cover of a two-piece cover is concerned do not drift apart or do not collapse inward any more.

According to one suggestion of the invention the hooking and locking elements are designed integrally with the halves of the cover or the cover and the upper rim of the container. In containers and covers made of plastic by injection molding, the hooking and locking elements can be simply molded at the same time. Alternatively, they could also later be inserted, clipped in or the like in a stable position in the prepared inlets.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
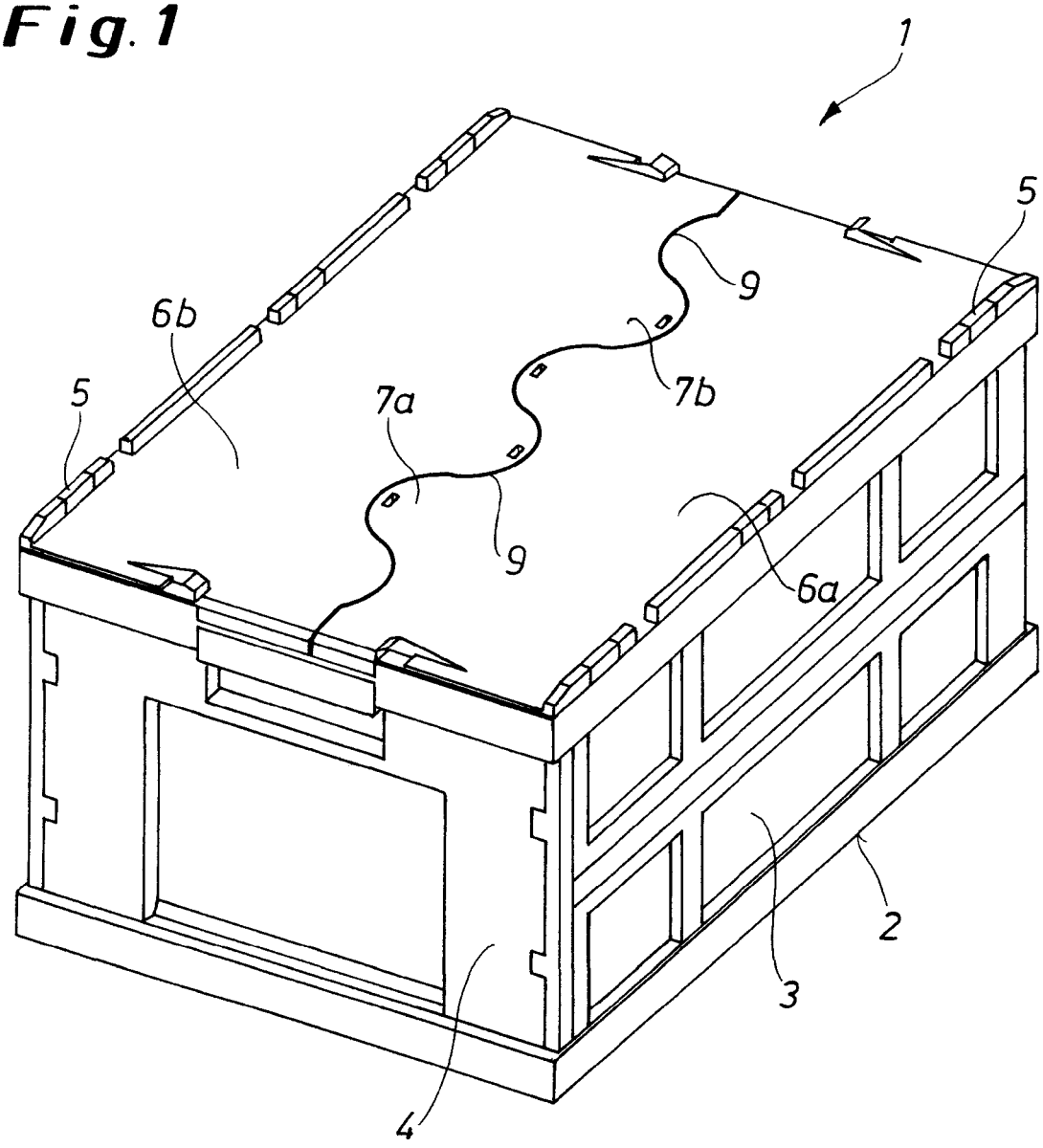
FIG. 1 is a closed container in a perspective top view.
Figure 2:
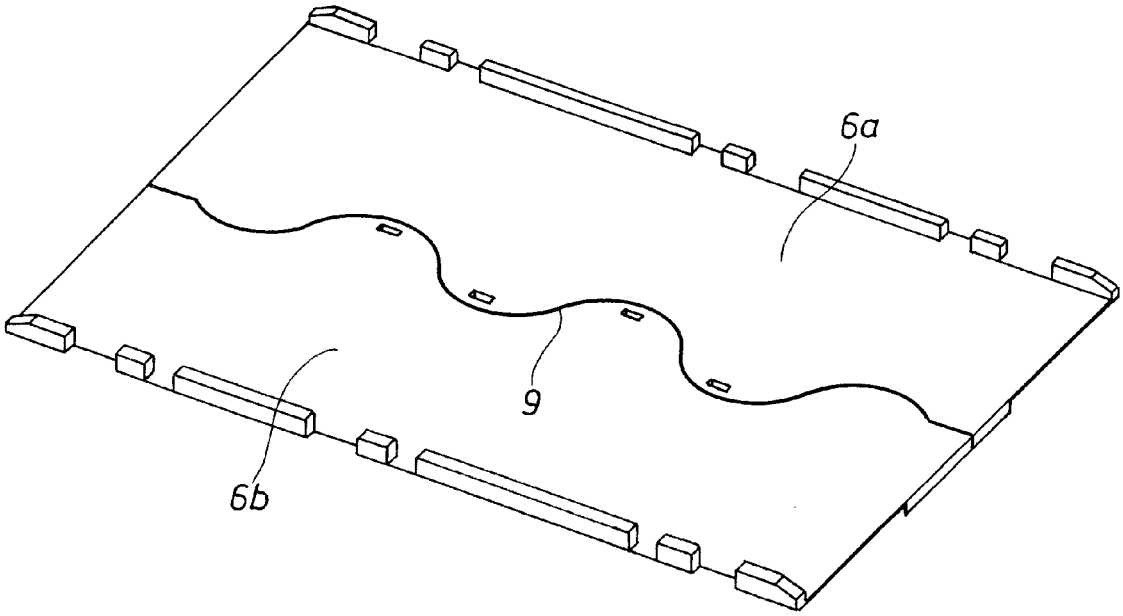
FIG. 2 shows the halves or panels of the cover interlocked along a closure line in a perspective view from above.
Figure 3:
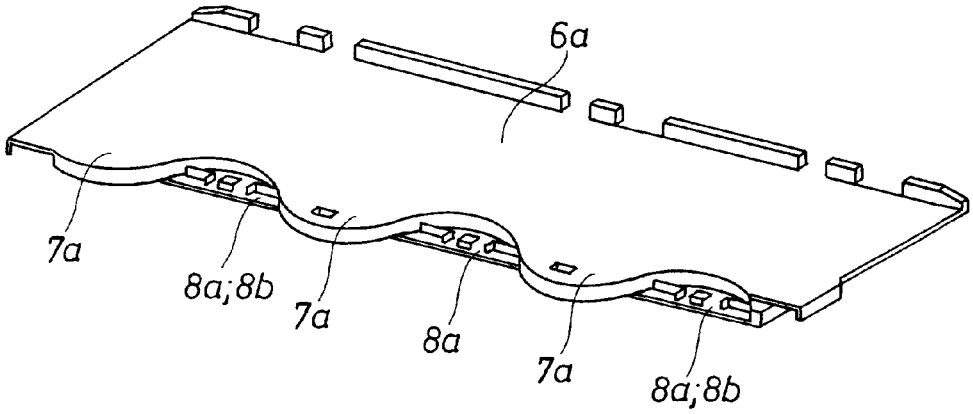
FIG. 3 is a perspective view from above of one half of the cover.
Figure 4:
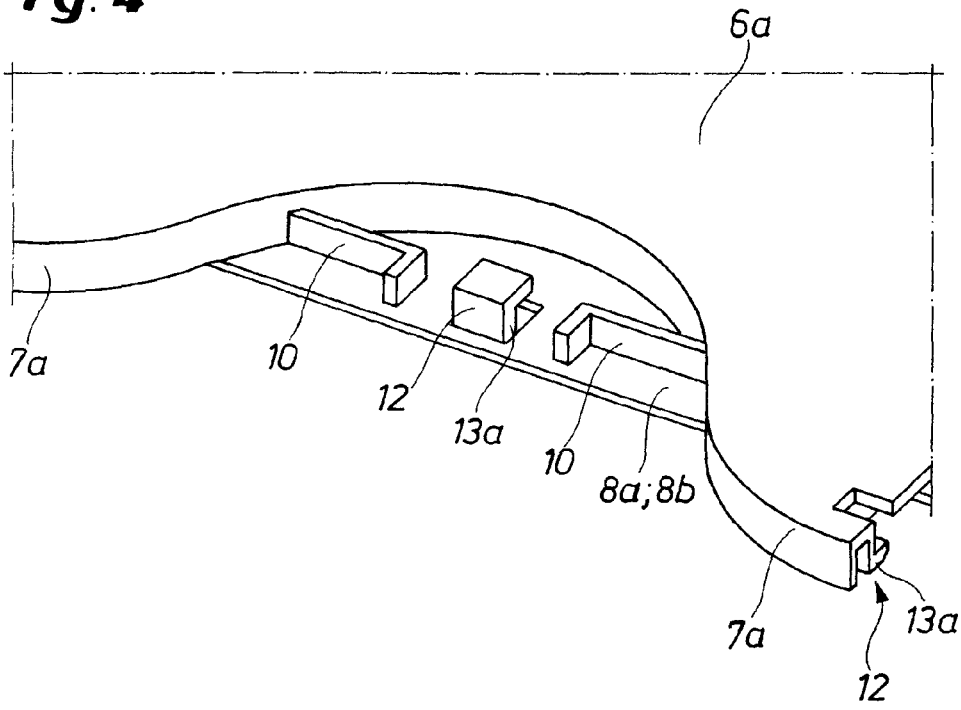
FIG. 4 is a perspective view from above of a detail of an inner edge of a cover.
Figure 5:
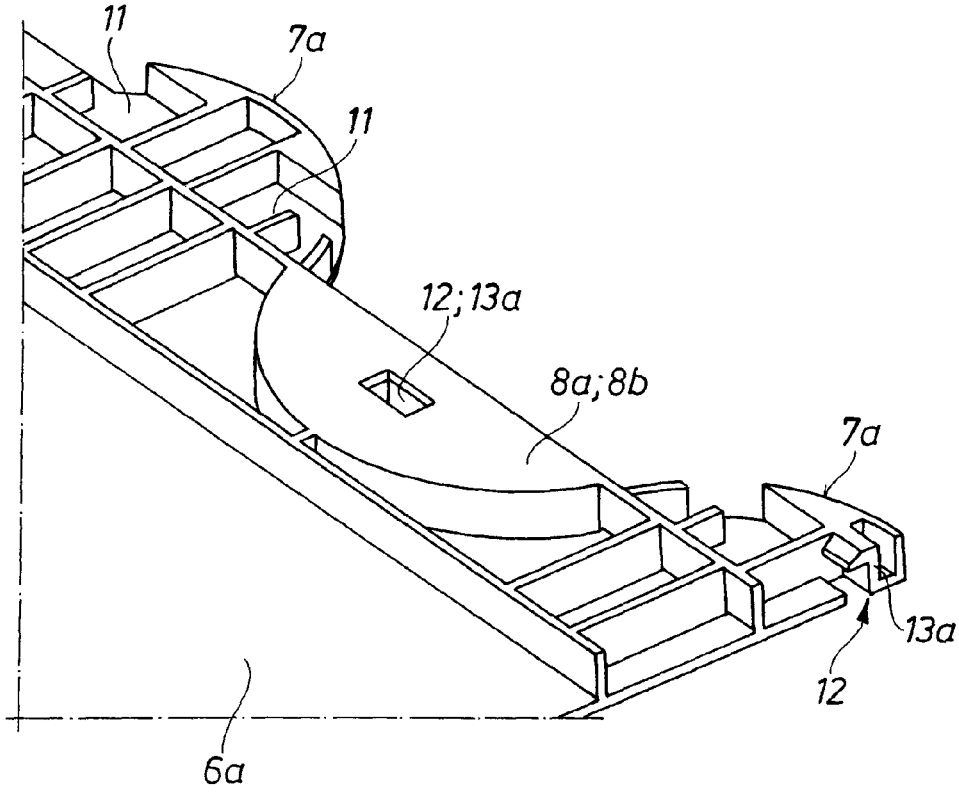
FIG. 5 is a perspective view from below of the cover edge.

As seen in FIG. 1 a container or box 1 for storage, stacking and transport has a basically parallelepipedal shape with a floor 2, two upright long side walls 3 projecting upward therefrom, and two upright short end walls 4 bridging longitudinal ends of the side walls 3 and projecting upward from the short ends of the floor 2. Instead of this one-piece design, the longitudinal and transverse walls 3 and 4 can also be collapsible or foldable. At the upper ends of the longitudinal walls 3, two cover halves or panels 6*a* or 6*b* are mounted on hinges 5 for pivoting about parallel horizontal axes at upper edges or rims of the side walls 3. The cover halves 6*a* or 6*b* at their free inner edges are provided with part-circular cover tabs 7*a* or 7*b* alternating with complementary recesses 8*a* or 8*b* so that the cover-half inner edges can fit complementarily together. In the closed position, the two cover halves 6*a* or 6*b* overlap with their cover tabs 7*a* or 7*b* which are received by the corresponding recesses 8*a* or 8*b* of the other half of the cover. Due to the outline of the cover tabs 7*a* or 7*b*, the closure line 9 (see also FIGS. 2-5) is wavy in the closed position.

Figure 7:
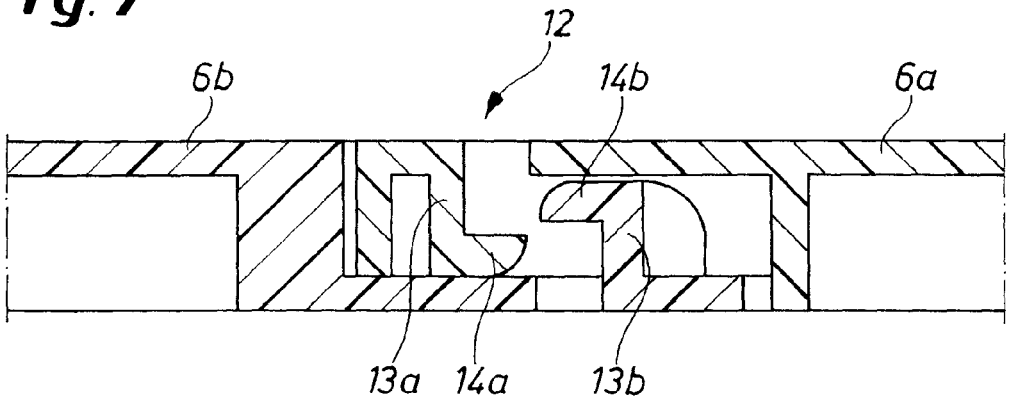
FIG. 7 is a view like FIG. 6 but with the cover in the closed position and not under load.
Figure 8:
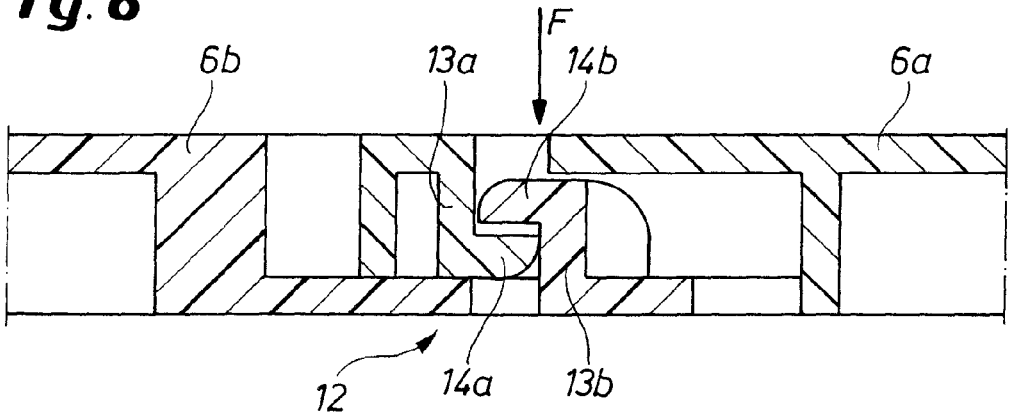
FIG. 8 is a view like FIG. 7 but with the cover under load.

At the free inner edges or ends of the cover halves 6*a* and 6*b* which face each other, interlocking retaining elements in the form of groove-ridge connections (see L-shaped ridges 10 and the complementary grooves 11 in FIGS. 4 and 5) are provided along the closure line 9 both on the upper sides of the recesses 8*a* and 8*b* and complementary on the undersides of the other cover half 6*a* or 6*b*. In addition, additional locking elements 12 are provided, again both on the upper side of one cover half 6*a* or 6*b* and on the underside of the other cover half 6*a* or 6*b*. These locking elements consist of basically L-shaped bolt stems (see FIGS. 6 to 8), wherein the cover half 6*a*, the cover tabs 7*a* of which come to lie in the recesses 8*b* when the cover is closed, has a low lying bolt head 14*a* on a bolt stem 13*a*, while a bolt stem 13*b* of the cover half 6*b* has a higher bolt head 14*b*. The bolt heads 14*a* and 14*b* project oppositely away from each other.

Figure 6:
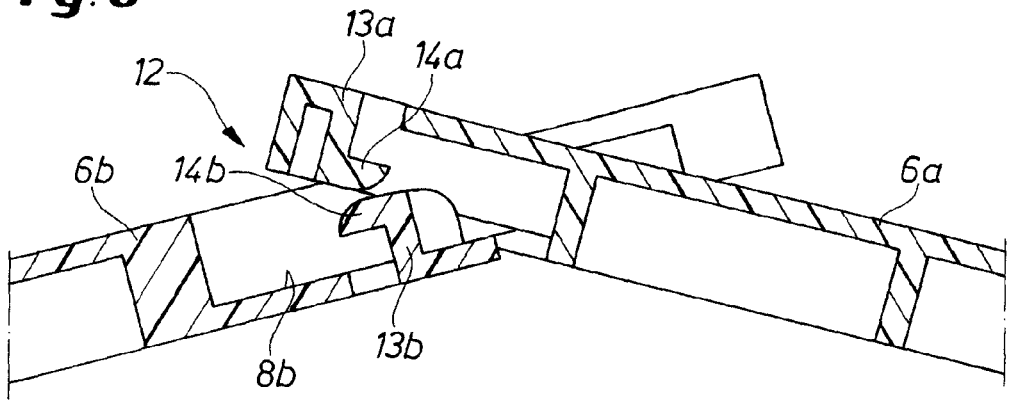
FIG. 6 is a large-scale section through the inner edges of the cover panels in a partly closed position.

FIG. 6 shows an intermediate position in the cover closing procedure of the two cover halves 6*a* and 6*b*. The completely closed cover position can be seen in FIG. 7. If a load or pressure acts on the lower container (see arrow F in FIG. 8) when the containers 1 are stacked one upon the other, the hooking and locking elements 12 or the L-shaped bolt stems 13*a*, 13*b* depending on the load or the pressure shift against each other starting from the unloaded position according to FIG. 7 and are more and more interlocked due to the bolt heads 14*a* and 14*b* overlapping and gripping under one another. The cover halves 6*a* and 6*b* interlock automatically and prevent release the groove-ridge connections 10, 11 when a heavy load is applied, since a bending or drifting apart of the cover halves 6*a* and 6*b* is solidly prevented by the hooking and locking elements 12.

I claim:

1. A storage/transport container comprising:

a plurality of walls defining an upwardly open vessel having an upper rim;

a generally flat cover panel hinged on one of the walls and having an inner edge, the rim having opposite to the one of the walls another inner edge, the cover panel being pivotal into a closed position with the inner edges juxtaposed;

retaining formations projecting generally perpendicularly from the inner edge of the cover panel and oppositely from the other inner edge that fit together in the closed position; and hooks formed on the edges, positioned so as to be opened directly away from each other in the closed position, and each having a hook part spaced from the respective inner edge, the hooks normally being spaced apart but, on deformation of the cover panel, hooking together with each hook part engaging between the other hook part and the inner edge of the other hook part and preventing separation of the edges.

2. The storage/transport container defined in claim 1 wherein there are a plurality of the hooks on each of the inner edges.

3. The storage/transport container defined in claim 2 wherein the hooks are provided on an underside of the inner edge of the panel and project upward from the other inner edge.

4. The storage/transport container defined in claim 2 wherein the hooks are formed unitarily with the respective edges.

5. A storage/transport container comprising:

four walls defining an upwardly open parallelepipedal vessel having a rectangular upper rim;

a pair of generally flat cover panels hinged parallel to each other on opposite sides of the rim and having interfitting inner edges, the cover panels being pivotal into closed positions with the inner edges fitting together and juxtaposed;

retaining formations projecting generally perpendicularly from the inner edges of the cover panels and interfitting in the closed position; and hooks formed on the edges and positioned so as to be opened directly away from each other in the closed position, and each having a hook part spaced from the respective inner edge, the hooks normally being spaced apart but, on deformation of the cover panel, hooking together with each hook part engaging between the other hook part and the inner edge of the other hook part and preventing separation of the edges in a plane of the cover panels.

6. The container defined in claim 5 wherein the retaining formations project in the closed position upward from one of the edges and downward from the other of the edges.

7. The container defined in claim 5 wherein the retaining formations of one of edges are transverse ridges and the retaining formations of the other of the edges are recesses.

8. The container defined in claim 5 wherein the cover panels, retaining formations, and hooks are unitarily formed of rigid but deformable plastic.

9. The container defined in claim 5 wherein in the closed position when the panels are substantially planar the hooks are spaced apart, but when the panels are downwardly deformed and upwardly concave, the hooks fit together.

10. The container defined in claim 5 wherein in the closed position when the cover panel is not deformed the hooks are spaced from each other and the panels can pivot freely up out of the closed position.

11. The container defined in claim 1 wherein the cover panel is pivotal about an axis and the hook of the cover panel is open toward the axis, the other hook of the other inner edge is open away from the axis.

12. The container defined in claim 11 wherein in the closed position when the cover panel is not deformed the hooks are spaced from each other and the panels can pivot freely up out of the closed position.

* * * * *